United States Patent [19]

Ivers et al.

[11] 4,203,265

[45] May 20, 1980

[54] HUB AND STRUT SYSTEM FOR GEODESIC DOMES

[75] Inventors: Robert P. Ivers; Mark J. Thimsen, both of Minnetonka, Minn.

[73] Assignee: Geodesic Shelters, Inc., Minnetonka, Minn.

[21] Appl. No.: 905,227

[22] Filed: May 12, 1978

[51] Int. Cl.[2] ..... E04B 1/32

[52] U.S. Cl. ..... 52/81

[58] Field of Search ..... 52/80, 81, 83, 86, DIG. 10; 403/170, 171, 172, 174, 176

[56] References Cited

U.S. PATENT DOCUMENTS

| | | | |
|---|---|---|---|
| 3,022,590 | 10/1961 | Hannoosh | 52/81 |
| 3,254,459 | 6/1966 | Bodley | 52/81 |
| 3,492,034 | 1/1970 | Skipp | 52/656 |
| 3,909,994 | 10/1975 | Richter | 52/81 |
| 3,953,948 | 5/1976 | Hogan | 52/DIG. 10 |

FOREIGN PATENT DOCUMENTS

| | | | |
|---|---|---|---|
| 900902 | 7/1962 | United Kingdom | 52/81 |
| 929862 | 6/1963 | United Kingdom | 52/81 |
| 1033819 | 6/1966 | United Kingdom | 52/81 |

*Primary Examiner*—James A. Leppink
*Assistant Examiner*—Henry E. Raduazo
*Attorney, Agent, or Firm*—Burd, Bartz & Gutenkauf

[57] ABSTRACT

A simplified hub and strut system for the construction and assembly of geodesic domes. The system is characterized by the outer faces of the hubs and struts being provided with recessed rabbets which function as shoulders for receiving flat nesting panels of transparent or opaque rigid sheet material comprising the outer skin of an assembled dome. The inner faces of the struts are desirably also provided with recessed rabbets to function as shoulders on which to seat interior panels of rigid sheet material. The system is also characterized by the use of aligning dowels to facilitate initial assembly of hubs and struts preliminary to fastening.

8 Claims, 12 Drawing Figures

FIG. 1
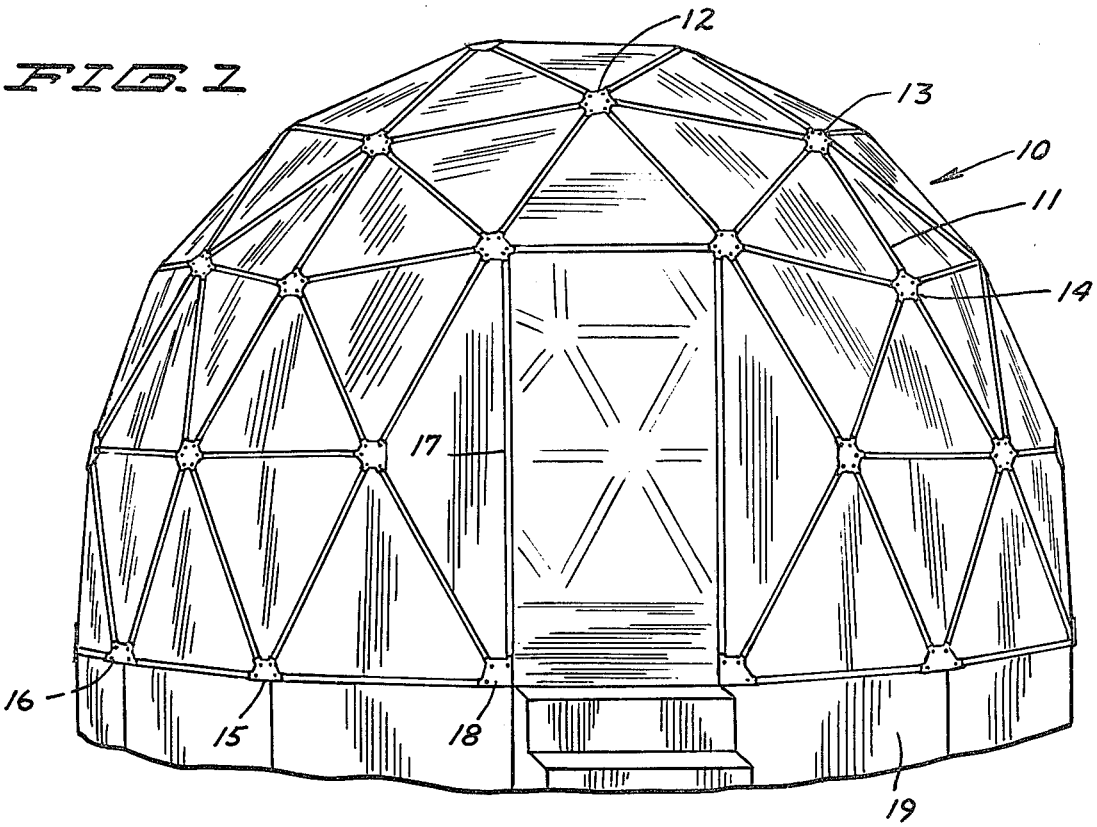
FIG. 2
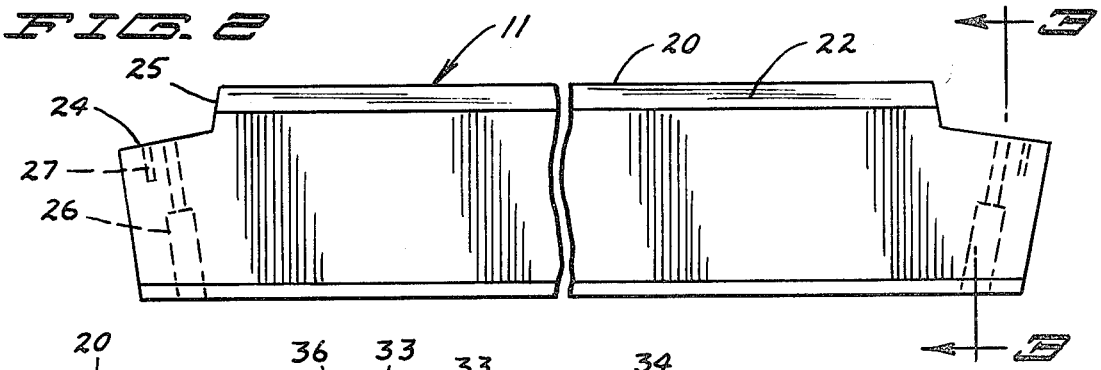
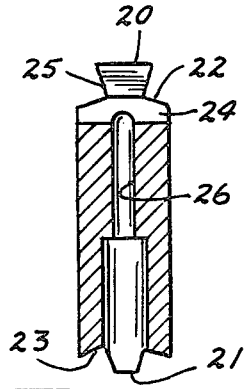
FIG. 3
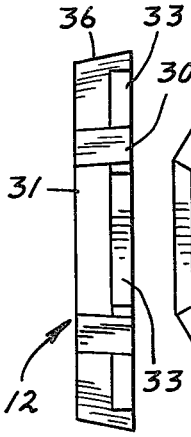
FIG. 5
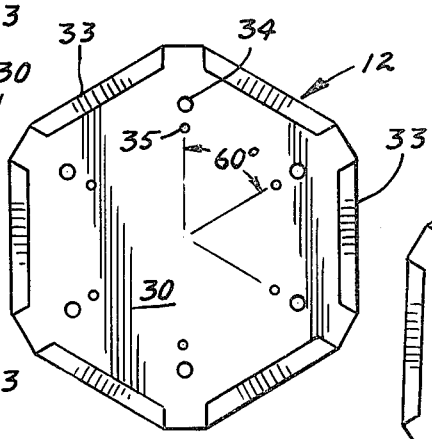
FIG. 4
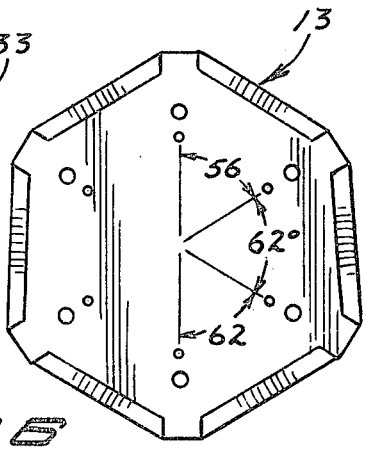
FIG. 6

HUB AND STRUT SYSTEM FOR GEODESIC DOMES

This invention is directed to a hub and strut system for the simplified construction and assembly of geodesic domes. The dome is a hemispherical type structure composed of a plurality of flat triangular sections defined by elongated struts whose ends are held together by hubs or gusset plates.

Broadly stated, the hub and strut system according to the present invention comprises a plurality of generally flat polygonal hub or gusset plates each having an inner and outer face. Each hub plate has a plurality of spaced apart rabbets recessed into the outer face of the plate along those polygonal edges of the hub which in part define dome segments converging at the hub. Each hub has a plurality of fastener-receiving apertures which extend through the plate spaced inwardly from the edges adjacent the ends of the recessed rabbets and along generally radial lines.

The system includes a plurality of elongated struts which converge upon a hub. The struts are of generally rectangular cross section and have inner and outer faces. A rabbet is recessed into each of the opposite edges of at least the outer strut face and extends the length of the strut. The hub rabbets and strut rabbets form shoulders on which flat rigid panels may be seated to enclose the dome. Each strut has an angular hub engaging shoulder recessed into the outer strut face at each end of the struts. A plurality of fastener-receiving apertures extend through each of these shoulders and fastening means extend through the apertures in both hub and struts to secure them together in dome form.

The invention is illustrated in the accompanying drawings in which corresponding parts are identified by the same numerals in which corresponding parts are identified by the same numerals and in which:

FIG. 1 is a perspective view of a geodesic dome of the type which can be constructed utilizing the hub and strut system of the present invention;

FIG. 2 is an elevation of a typical strut;

FIG. 3 is a section on the line 3—3 of FIG. 2 and in the direction of the arrows;

FIG. 4 is a top plan view of one form of hub plate;

FIG. 5 is an end elevation thereof;

FIGS. 6 through 9 are top plan views of other forms of hub plate necessary to complete a dome as in FIG. 1;

Figure 7:
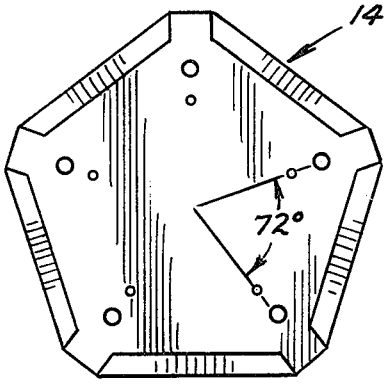
Figure 8:
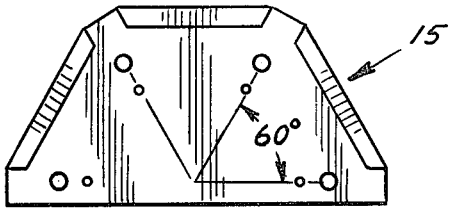
Figure 9:
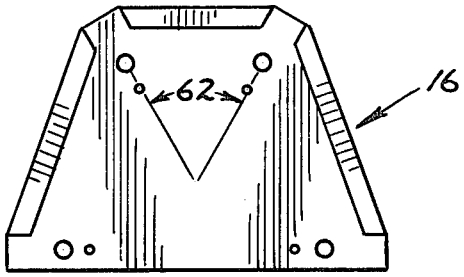

Referring now to the drawings, there is shown in FIG. 1 a typical geodesic dome structure of the type adapted to be constructed utilizing the hub and strut system according to the present invention. Although generally hemispherical, the illustrated dome represents approximately $\frac{5}{8}$ of a spherical icosahedron. For maximum utilization of the enclosed floor space, the dome comprises a hemisphere plus an added course of components defining a generally vertical wall raising the hemispherical dome portion above the foundation or other base surface.

The dome, indicated generally at 10, is composed of a plurality of elongated struts 11 whose ends come together at one of several different forms of hub or gusset plate 12 through 16. The result then is a generally hemispherical structure defined by a plurality of straight lines and planar surfaces. The struts define a plurality of triangular segments, some of which in turn, in combination, define hexagonal and pentagonal portions. For example, the triangular segments clustered around hubs 12 and 13 define hexagonal areas. Those clustered about hubs 14 define pentagonal areas, with some triangular segments lying both within a hexagonal and pentagonal area. Those struts clustered about the base or foundation hubs 15 and 16 define semi-hexagonal areas. Door frame members 17 connect to hubs 18, which are modified forms of base hubs 16, to define the door opening. As shown, the dome is supported on a raised foundation 19 but it may be constructed on any flat surface.

Referring now to FIGS. 2 and 3, there is shown a strut constructed according to the present invention. Strut 11 is elongated and of generally rectangular cross section. It has an outer face 20 and an inner parallel face 21. A rabbet 22 is recessed into each of the opposite edges of the outer strut face 20. This functions as a supporting shoulder upon which to seat rigid panels of flat sheet material for forming the outer skin of a completed dome. Preferably a further rabbet 23 is recessed into each of the opposite edges of the inner strut face 21 to provide a similar seat for interior skin panels.

Each end of the strut is provided with an angular hub-engaging shoulder 24. The face of shoulder 24 is disposed at a small angle relative to the outer strut face 20 and is adapted to engage the inner face of a hub or gusset plate, the precise angle being dependent upon the particular location and role of the strut, to provide the required overall dome contour. The end 25 of shoulder 24 is adapted to engage the edge of a hub or gusset plate. A counter-sunk bolt-receiving hole 26 is provided extending through the strut adjacent each end from the inner face to the shoulder for fastening the strut end to a hub. A further aperture 27 is provided in the face of shoulder 24 extending partway through the strut. Hole 27 is spaced from and parallel to the fastener-receiving hole 26 and is generally in longitudinal alignment therewith. It is adapted to receive one end of an aligning dowel or locating pin to facilitate assembly of struts and hubs. The struts may be formed, for example, from wood or from rigid synthetic resinous material or lightweight metal, or the like.

Referring now to FIGS. 4 and 5, there is shown one form of hub or gusset plate 12 in the general configuration of a symmetrical hexagon. The hub is in the form of a generally flat relatively thick plate having an outer face 30 and an inner face 31. A plurality of spaced apart rabbets 32 are recessed into the polygonal edges of the hub. The hub preferably has a thickness approximating the height of the shoulder wall 25 of the strut, and rabbet 33 is preferably of approximately the same depth as rabbet 22 on the strut. Rabbet 33 functions along with the corresponding rabbets of the struts to form a shoulder upon which to seat the rigid panels forming the outer dome skin. Rabbets 33 are spaced apart by a distance approximately equal to the thickness of the strut at the panel seating surface of rabbets 22.

A plurality of bolt-receiving holes 34 extend through the hub. Holes 34 are spaced inwardly from the edges of the hub by the same distance that holes 26 in the struts are spaced from the shoulder wall surfaces 25. The bolt-receiving holes lie on generally radial lines which are equally spaced from adjacent ends of the recessed rabbets. A plurality of holes 35 are provided for receiving aligning dowels or locating pins. Holes 35 lie along the same radial lines as holes 34, are generally parallel to holes 34 and spaced therefrom by the same distance that strut holes 26 and 27 are spaced apart. The edge 36 of the hub is slightly beveled from the larger area outer face 30 to the inner face 31 of smaller area. The angular configuration of the beveled edge 36 and inner face 31 corresponds to that of the strut shoulder surfaces 24 and 25 such that in the assembled joint, as shown in FIG. 11, the parts are joined in a close mating fit.

Hubs or gusset plates 13 through 16 and 18 are of similar construction having recessed rabbets, bolt-receiving holes and dowel-receiving holes. Hub 13 is in non-symmetrical hexagonal form for connecting the struts defining the triangular segments which form parts of both hexagonal and pentagonal areas. Hub 14 is in symmetrical pentagonal form for joining those struts defining triangular segments arrayed in pentagonal form. Hubs 8 and 9 abut the flat foundation surface and thus have recessed rabbets only along those edges forming parts of the triangular segments converging at those hubs. Hub 18 is further modified to accommodate the door frame. In every instance, the recessed rabbets correspond in number to the triangular dome segments converging at that particular hub. The hubs may be formed, for example, from wood or molded from rigid synthetic resinous material or lightweight metal, or the like.

Figure 10:
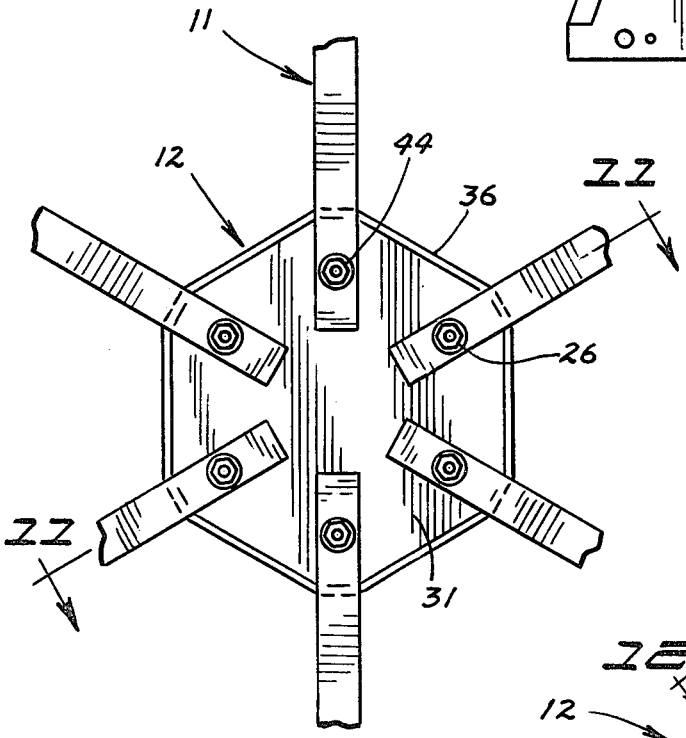
FIG. 10 is a plan view of an assembled hub and strut joint as viewed from the inside of the dome.
Figure 12:
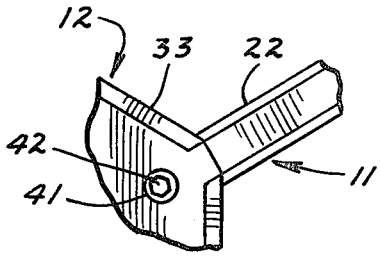
FIG. 12 is a fragmentary plan view of a portion of the assembled joint as viewed from outside the dome.
Figure 11:
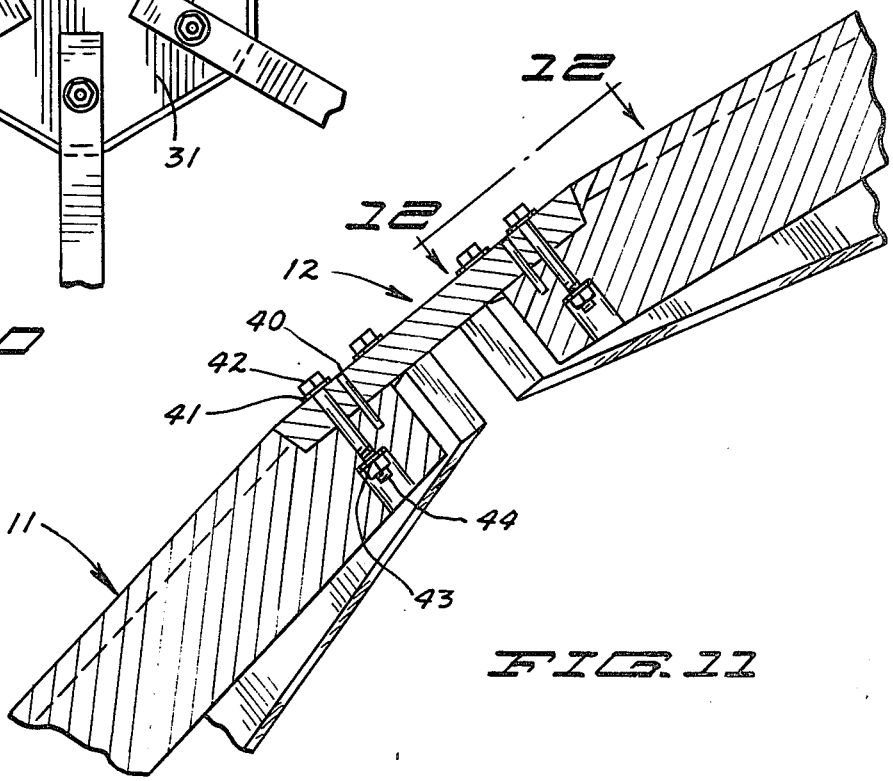
FIG. 11 is a section through the assembled joint of FIG. 10 on the line 11—11 and in the direction of the arrows.

Referring now to FIGS. 10 through 12, there is shown one typical assembled joint. Six struts 11 converge at hub 12. To facilitate assembly, a dowel or similar pin 40 is inserted in the dowel hole 27 in the strut end and then the protruding end of the pin is inserted into one of the dowel holes 35 of the hub. The joint is assembled such that the face of shoulder 24 abuts the inner face 31 of the hub and the shoulder end wall 25 abuts the beveled edge 36 of the hub. A washer 41 is preferably applied on bolt 42 and the bolt is inserted, from the outer face of the hub, through hole 34 in the hub and hole 26 in the end of the strut. The length of the bolt is such that its inner end is preferably recessed within the counter sunk bolt-receiving hole 26 in the strut. Then preferably another washer 43 and nut 44 are applied to the bolt and tightened. The other struts are joined in the same manner.

As seen in FIG. 12, the recessed rabbets 22 in the strut and the recessed rabbet 33 in the hub form a shoulder or ledge in the outer face of the dome frame for seating of the rigid skin panels. Those panels may be transparent to make a dome useful as a greenhouse or solar room, or they may be opaque, or a combination of transparent and opaque panels. Where the inner faces of the struts are rabbeted, the inner skin panels are seated in the same manner. To make the dome more energy efficient, suitable insulation may be installed between the outer and inner skins. The provision of rabbeted edges providing a seat for nesting of closely fitting rigid panels increases the rigidity of the dome and precludes shifting of the dome frame. A jig for precisely measuring skin panels is disclosed in our copending application Ser. No. 936,633, filed Aug. 24, 1978.

If desired, hole 24 can be extended through the strut, in which case a second bolt may be used as a dowel or locating pin to facilitate assembly. Then, a nut is applied to the second bolt for added strength and rigidity of the dome. Where additional strength may be required, a double dome frame may be constructed to form in effect a dome within a dome. The hub and strut system of the present invention makes it feasible to prefabricate the component parts and market the dome in kit form for do-it-yourself assembly.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A hub and strut system for geodesic domes comprising:

(A) a generally flat polygonal hub plate, said plate having an inner and outer face, (B) a plurality of spaced apart rabbets recessed into at least some of the polygonal edges of the plate in the outer face thereof, said rabbets corresponding in number to the triangular dome segments converging at the hub, (C) a plurality of fastener-receiving apertures extending through the plate spaced inwardly from the edges thereof adjacent the ends of said recessed rabbets and along generally radial lines, (D) a plurality of elongated struts converging upon said hub, said struts being of generally rectangular cross section and having inner and outer faces, (E) a rabbet recessed into each of the opposite edges of at least said outer strut faces and extending the length of the strut, (F) a hub-engaging surface at each end of said struts, (G) a fastener-receiving aperture extending through each of said struts adjacent the ends thereof, and (H) fastening means extending through the apertures in said hub and said struts to secure the same together.

2. A hub and strut system for geodesic domes according to claim 1 wherein said hub engaging surface is an angular shoulder recessed into the outer strut face at each end of said struts.

3. A hub and strut system for geodesic domes according to claim 1 wherein:

(A) said hub has a plurality of further dowel-receiving apertures parallel to said fastener-receiving apertures and spaced therefrom along the same generally radial lines, (B) each of said struts has a further dowel-receiving aperture parallel to and spaced longitudinally from said fastener-receiving aperture, and (C) an aligning dowel extends through the apertures in said hub and said struts to facilitate initial alignment of the same.

4. A hub and strut system for geodesic domes according to claim 3 wherein said dowel aligning apertures are spaced inwardly relative to the fastener-receiving aperture of said hub and outwardly relative to the fastener-receiving aperture of said struts.

5. A hub and strut system for geodesic domes according to claim 1 wherein a rabbet is recessed into each of the opposite edges of said inner strut faces extending the length of the strut.

6. A hub and strut system for geodesic domes according to claim 1 wherein said rabbets in said hub and in the outer face of said struts are of equal depth.

7. A hub and strut system for geodesic domes according to claim 1 wherein the edges of said hub adjacent said recessed rabbets are beveled inwardly and said struts adjacent the shoulders thereof are inclined at the same angle.

8. A hub and strut system for geodesic domes according to claim 1 wherein said hub and said struts are composed of wood and said fastening means are bolts.

* * * * *

UNITED STATES PATENT AND TRADEMARK OFFICE

CERTIFICATE OF CORRECTION

PATENT NO. : 4,203,265

DATED : May 20, 1980

INVENTOR(S) : Robert P. Ivers et al

It is certified that error appears in the above-identified patent and that said Letters Patent are hereby corrected as shown below:

On the title page, under "References Cited", U. S. Patent No. "3,022,590" should be --3,002,590--.

Signed and Sealed this

*Second* Day of *September 1980*

[SEAL]

*Attest:*

SIDNEY A. DIAMOND

*Commissioner of Patents and Trademarks*

*Attesting Officer*